US010667601B1

(12) United States Patent
Newton

(10) Patent No.: US 10,667,601 B1
(45) Date of Patent: Jun. 2, 2020

(54) PAINT PEN SYSTEM AND METHOD

(71) Applicant: Peter H. Newton, Powell, OH (US)

(72) Inventor: Peter H. Newton, Powell, OH (US)

( * ) Notice: Subject to any disclaimer, the term of this patent is extended or adjusted under 35 U.S.C. 154(b) by 40 days.

(21) Appl. No.: 15/795,860

(22) Filed: Oct. 27, 2017

(51) Int. Cl.
*B65D 81/32* (2006.01)
*A46B 11/00* (2006.01)

(52) U.S. Cl.
CPC ..... *A46B 11/0013* (2013.01); *A46B 11/0072* (2013.01)

(58) Field of Classification Search
CPC ..... A46B 11/0013; A46B 11/0055; A46B 11/0072; B65D 81/3255
See application file for complete search history.

(56) References Cited

U.S. PATENT DOCUMENTS 1,615,104 A * 1/1927 Walker ..... A46B 11/0013 401/150
2,255,879 A * 9/1941 Garvey ..... A46B 11/0013 222/518
5,568,988 A 10/1996 Knox et al.
2005/0100390 A1* 5/2005 Jantz ..... A46B 11/0055 401/179
2007/0231054 A1* 10/2007 Wales ..... A46B 5/0008 401/280
2014/0328611 A1* 11/2014 Ishida ..... A45D 34/04 401/184
2018/0045627 A1* 2/2018 Blankenstein ..... B01F 13/0022

* cited by examiner

*Primary Examiner* — J C Jacyna
(74) *Attorney, Agent, or Firm* — Ronald J. Koch; The Eley Law Firm

(57) ABSTRACT

A valve housing adapter for a paint pen kit includes a protruding inlet, a protruding outlet and a valve. The protruding inlet is adapted to matingly fit a syringe housing and the protruding outlet is adapted to matingly fit a paint tube housing. The valve having a closed position configured to bias a plug so as to prevent fluid flow through a dispensing tip of the syringe housing in the closed position when the protruding inlet is matingly fitted to the syringe housing. The valve is further configured to flex to an open position whereby the plug is no longer restrained relative to the dispensing tip of the syringe housing.

8 Claims, 4 Drawing Sheets

PAINT PEN SYSTEM AND METHOD

BACKGROUND AND SUMMARY

The present invention relates generally to a system and method for a paint pen dispenser, and more particularly, to a syringe adapter valve for a paint pen kit that utilizes a plug movable from a sealing, retained position to a free-floating position inside a paint tube housing in order to provide a fluid transfer and/or mixing of fluids.

In one aspect, the subject technology presents a system and method for making and using a one use, two fluid component 'touch-up' paint pen kit for touching up paints that require hardeners (i.e. epoxies, urethane, etc).

In one aspect, the subject technology comprises a valve and a valve housing for an adapter that allows combining of an existing off-the-shelf syringe and open ended paint pen, wherein the valve utilizes a plug (a stainless steel spherical ball in one aspect) that distorts the valve as pressure from the syringe is applied to the ball, thus opening the valve and combining the fluid material (e.g. paint pigment and urethane in one aspect). In one aspect, the ball is used as an agitator in the combined mixture to assist in mixing the fluids. The spirit of the invention contemplates a plug being restrained by a valve in a closed position that can be deformed under pressure to an open position to effectively allow the plug to be discharged. Accordingly, various valve topologies can be utilized in addition to those depicted herein.

An inferior paint pen product has been described in U.S. Pat. No. 5,568,988 to Knox et al., issued Oct. 29, 1996 (referred to '988 herein). The '988 device incorporates an internal disk that separates a tube into two chambers. Once an exterior ring is moved and the disk becomes dislodged, the material combines and is mixed. The '988 has numerous disadvantages, including that the system must be configured and filled at a factory with specially designed (expensive) equipment to set the disk and the exterior ring. Conversely, the subject technology can be filled with little or no special equipment.

The subject technology is has many other advantages over conventional systems, as presented herein, and as will be apparent to those of skill in the art after studying the subject technology, including allowing use of off-the-shelf syringe and paint pen components (results in decreased costs), and ease of use (e.g. initially filling).

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
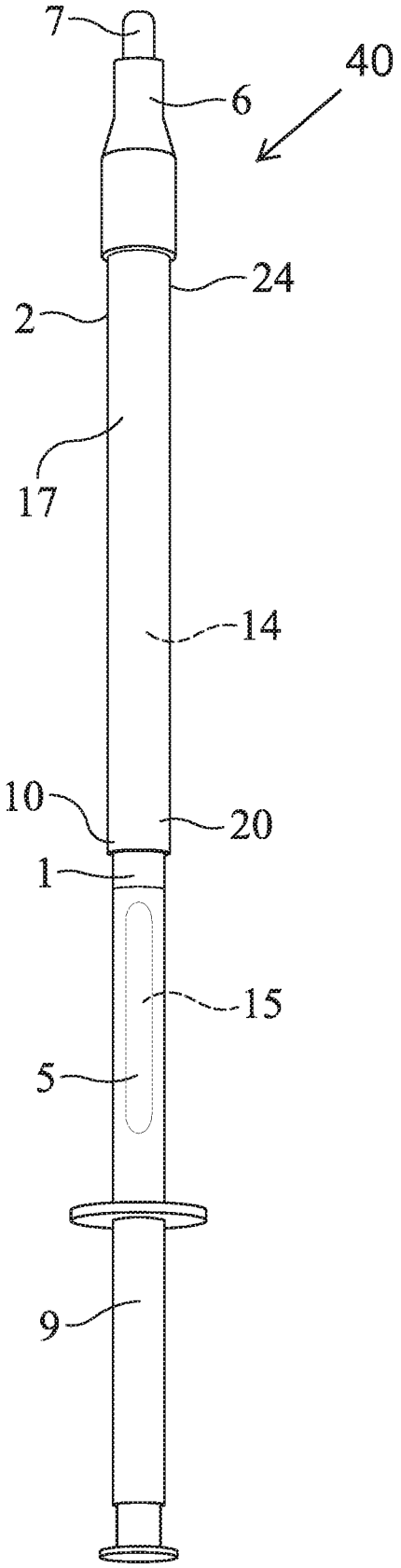
FIG. 1 is a side elevation view of an assembled paint pen kit according to one aspect of the subject technology.

In the discussion that follows, like reference numerals are used to refer to like structures and elements in the various figures.

Figure 1A:
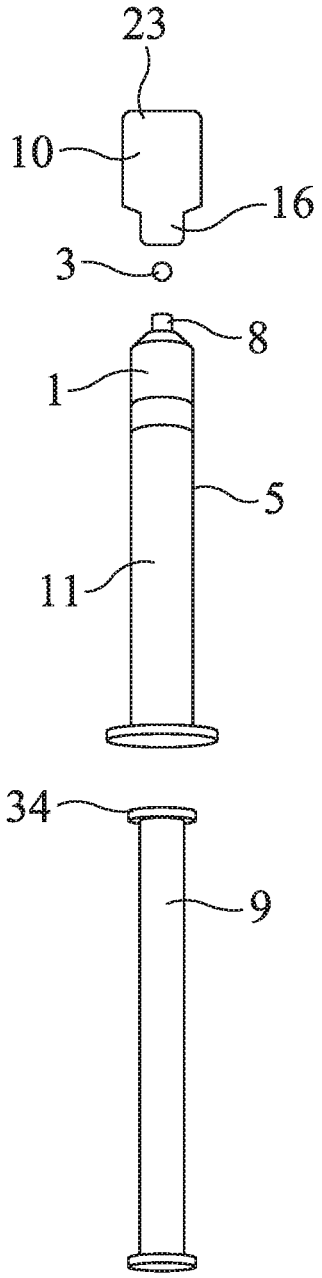
FIG. 1A is an exploded view showing the valve housing, plug, syringe housing and plunger of the paint pen kit of FIG. 1.

Referring to FIGS. 1 and 1A, in some aspects, a paint pen kit 40 for mixing and dispensing paint includes a syringe housing 5, a plunger 9 configured to operatively engage syringe housing 5, a valve housing 10, a paint tube housing 2, and an applicator 6 disposed on a dispensing end 24 of paint tube housing 2. Valve housing 10 is configured as an adapter to allow connection between syringe housing 5 and paint tube housing 2, and is also configured to allow for a fluid transfer from syringe housing 5 to paint tube housing 2.

Referring to FIGS. 2A and 3-5, valve housing 10 includes a protruding inlet 16, a protruding outlet 23, and a valve 18. Protruding inlet 16 is disposed proximate a shoulder portion 4 and is adapted to matingly fit syringe housing 5. In one aspect, protruding inlet 16 has a threaded portion 22 disposed on an outer surface 21. Threaded portion 22 is adapted to matingly fit a threaded sleeve 1 of syringe housing 5. Threaded sleeve 1 radially surrounds a portion of dispensing tip 8 of syringe housing 5.

Valve housing 10 is adapted to form a fluid tight seal between paint tube housing 2 and syringe housing 5. Protruding outlet 23 extends from shoulder portion 4 of valve housing 10 and is adapted to matingly fit filling end 20 of paint tube housing 2 (abuts shoulder portion 4 of valve housing 10 in one aspect). In one aspect, protruding outlet 23 is adapted to friction fit filling end 20 of paint tube housing 2.

Figure 2:
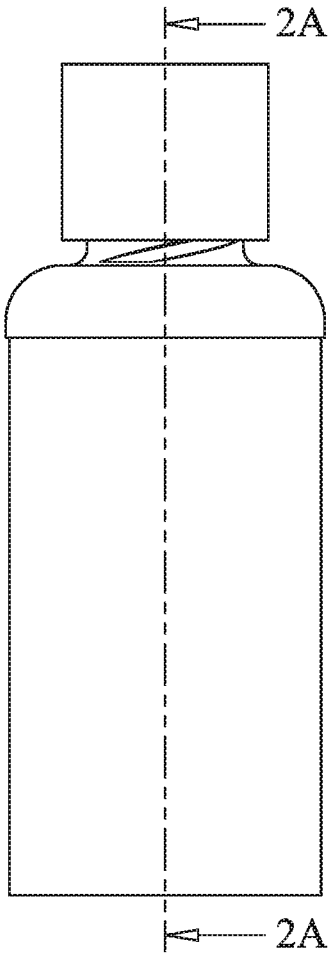
FIG. 2 is side view of a portion of the threaded sleeve and dispensing tip (of the syringe housing) and a portion of the paint tube housing assembled onto the valve housing.
Figure 2A:
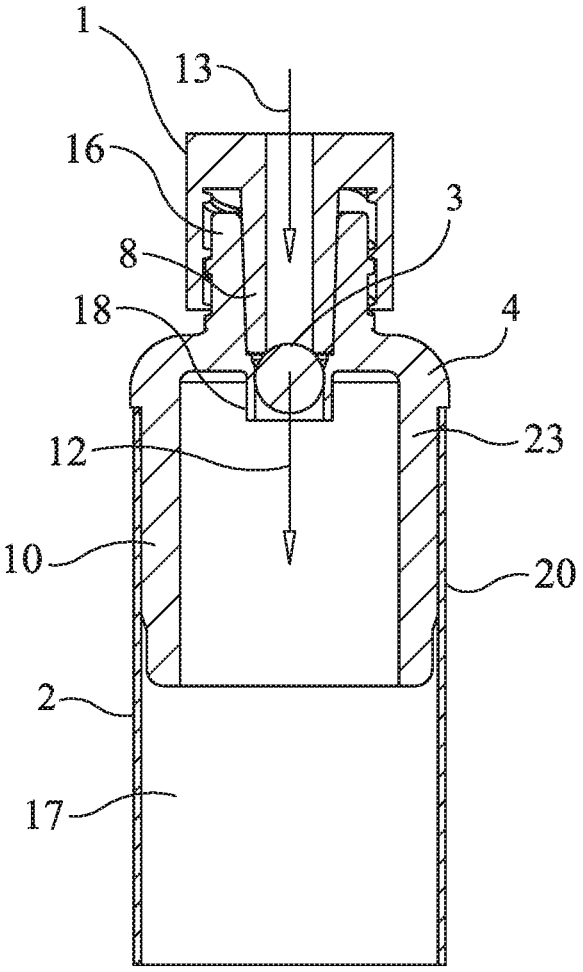
FIG. 2A is a longitudinal section through FIG. 2 showing the valve in the closed position.

Valve 18 has a closed position (FIG. 2A), to operatively create a fluid-tight seal when plug 3 is in place, and an open position which allows release of plug 3 and subsequent fluid transfer. Referring to FIG. 2A, valve 18 is in the closed position, syringe housing 5 is matingly fitted to protruding inlet 16, and plug 3 is restrained by valve 18 so as to prevent fluid flow through a dispensing tip 8 of syringe housing 5. In one aspect, valve 18 temporarily flexes to the open position and returns to the closed position when plug 3 is dislodged. In another aspect, valve 18 is permanently distorted to the open position. Plug 3 is a stainless steel spherical ball in one aspect.

Figure 6:
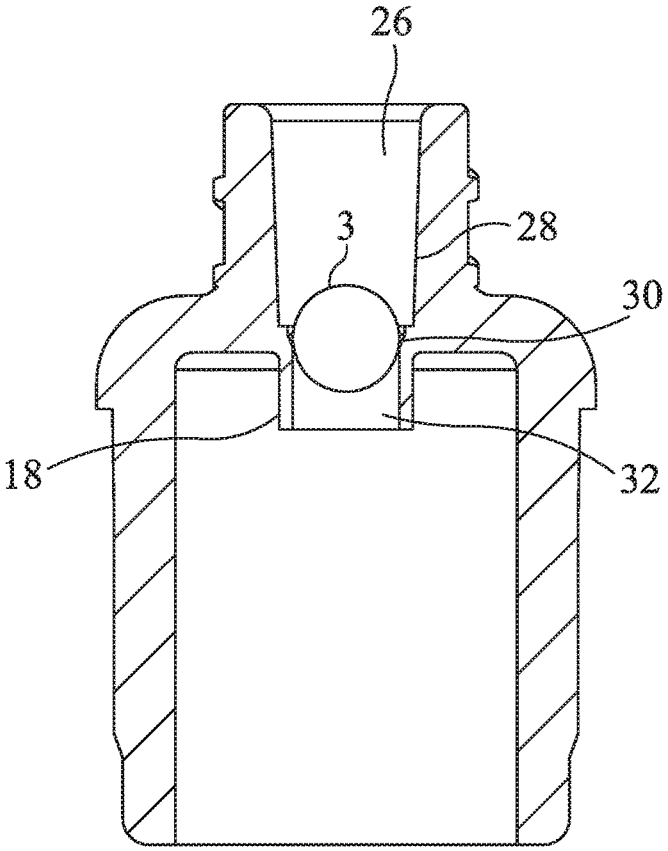
FIG. 6 is a longitudinal section showing the plug is inserted into the interior valve port.

Referring to FIG. 6, valve housing 10 includes an interior valve port 26 with inlet bore 28, seat 30, and outlet bore 32. Inlet bore 28 is configured to matingly receive dispensing tip 8 of syringe housing 5. In one aspect, seat 30 is configured to retain plug 3 when valve 18 is in the closed position.

Figure 3:
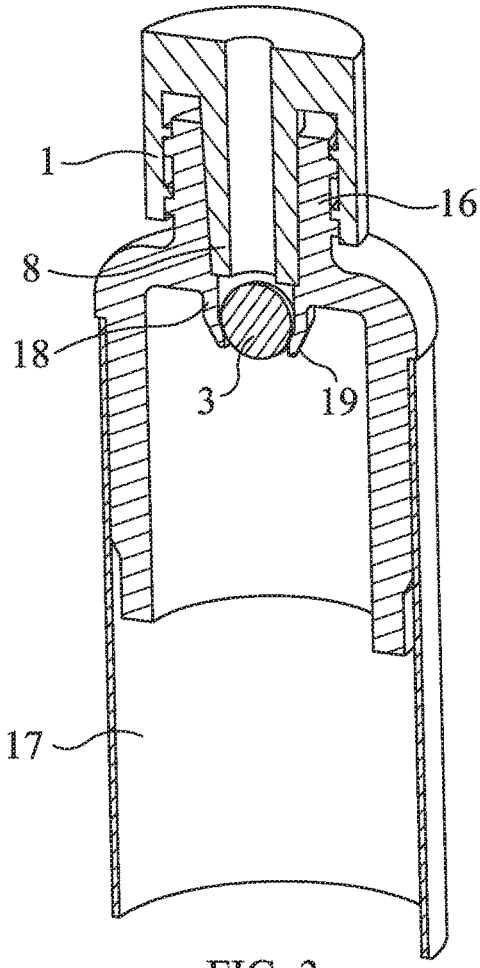
FIG. 3 is a sectional view showing an alternative valve topology according to another aspect of the subject technology.
Figure 4:
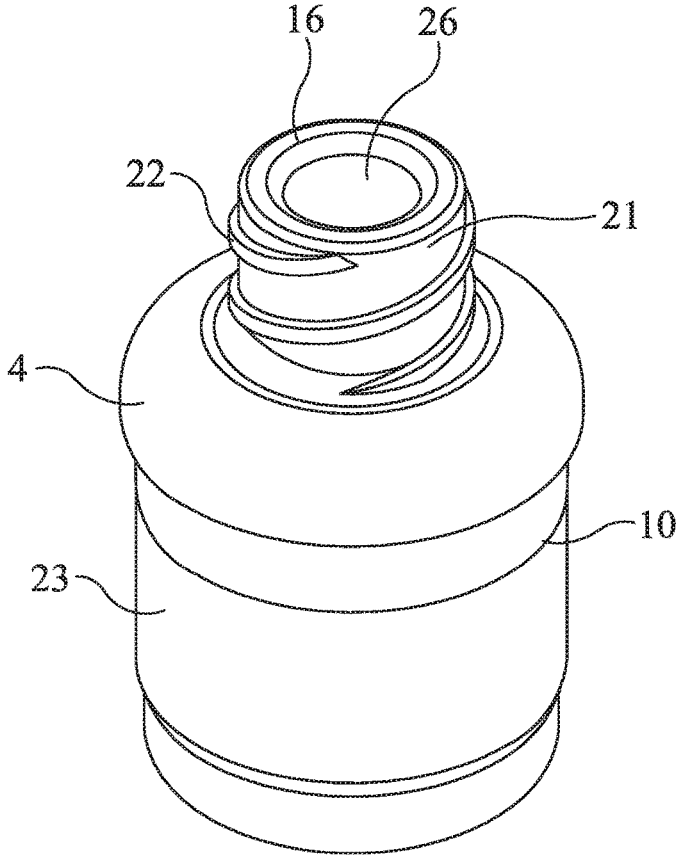
FIG. 4 is a perspective view of the valve housing.
Figure 5:
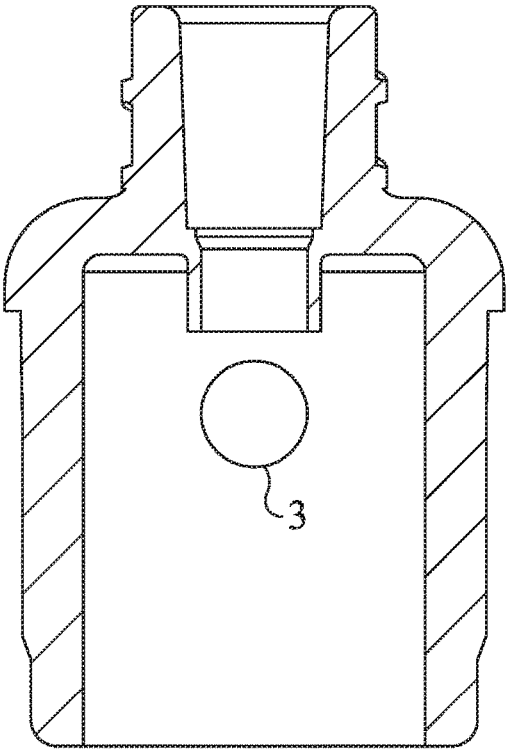
FIG. 5 is a longitudinal section through the valve housing, showing the plug having been released from a valve in the open position, in one aspect.

Referring to FIG. 3, in some aspects, valve 18 has a tapered portion 19 configured to restrain and bias plug 3 towards dispensing tip 8 of syringe housing 5. Tapered portion 19 acts in a cooperating manner to flex between open and closed positions as fluid pressure/force is applied to plug 3 in the direction of flow arrow 13 (FIG. 2A).

A method of assembling and using a paint pen kit 40 includes obtaining, as described above, syringe housing 5, plunger 9, paint tube housing 2 with applicator 6, and valve housing 10;

Next, one would matingly fit the protruding outlet 23 of valve housing 10 to filling end 20 of paint tube housing 2. Next, one would insert plug 3 into protruding inlet 16 of valve housing 10, via inlet bore 28 of interior valve port 26, such that plug 3 is restrained (e.g. plug 3 sets at seat 30 of the interior valve port). Then one would matingly fit threaded sleeve 1 of syringe housing 5 to protruding inlet 16 of valve housing 10. Threading down threaded sleeve 1 onto threaded portion 22 of protruding inlet 16 also results in insertion of dispensing tip 8 into inlet bore 28 (see FIG. 6).

As threaded sleeve 1 is threaded further down onto threaded portion 22, the end of dispensing tip 8 engages and urges plug 3 down from seat 30 toward engagement with outlet bore 32. Referring again to FIG. 2A, inlet bore 28 is adapted to matingly fit the outside wall of dispensing tip 8 and form a fluid-tight seal when fully assembled. Once threaded sleeve 1 is fully threaded onto threaded portion 22, plug 3 is securely retained inside outlet bore 32 of valve 18 by friction fit and biased in place by dispensing tip 8, to effectively form the closed position.

Next, one would dispense a first fluid 15 into an inner chamber 11 of syringe housing 5 (first fluid 15 is shown schematically in FIG. 1A). Inner chamber 11 is configured to contain the first fluid 15. In one aspect, the first fluid is a curing agent or hardener (i.e. epoxies, urethane, etc) suitable to be mixed with second fluid 14 just prior to application as touch-up paint to a surface.

Next, one would insert a disk end 34 of plunger 9 into syringe housing 5 to seal and contain first fluid 15 within inner chamber 11. Then, one would continue to insert plunger 9 into syringe housing 5 so as to urge first fluid 15 in the direction of flow arrow 13 through dispensing tip 8 of syringe housing 5. The pressure from first fluid 15 pushes against plug 3 to move the plug down to the end of outlet bore 32 by causing the outlet bore to flex and distort. Plug 3 is moved by first fluid 15 until it is fully dislodged into inner chamber 17 in the direction of arrow 12.

With plug 3 removed, one continues to insert plunger 9 into syringe housing 5 such that first fluid 15 is substantially transferred into inner chamber 17 of paint tube housing 2. As first fluid 15 is transferred into inner chamber 17, the first fluid comingles and mixes with second fluid 14 inside paint tube housing 2.

Inner chamber 17 of paint tube housing 2 contains a second fluid 14, either as purchased, or dispensed into filling end 20 (second fluid 14 is shown schematically in assembled paint pen kit 40 in FIG. 1A). Known types of applicator 6 typically also include an end cap (not shown) to protect applicator tip 7.

Inner chamber 17 is configured to contain second fluid 14, where the second fluid is suitable for forming a two-part paint mixture used for touch-up application to a suitable surface. The normally-closed dispensing valve retains second fluid 14 within inner chamber 17.

In one aspect, plug 3 is capable of acting as an agitator to assist in mixing (e.g. via manual shaking of paint pen kit 40). Once the paint is ready, the end cap may be removed, and the dispensing valve of applicator 6 may be activated to dispense paint from applicator tip 7.

Those of skill in the art will appreciate that the subject technology is adapted to fit various off the shelf syringes/syringe housings, and paint tubes, and can be configured to fit specific models.

While this invention has been shown and described with respect to a detailed embodiment thereof, it will be understood by those skilled in the art that changes in form and detail thereof may be made without departing from the scope of the claims of the invention.

The invention is in no way limited to the specifics of any particular embodiments and examples disclosed herein. For example, the terms "aspect," "example," "preferably," "alternatively," and the like denote features that may be preferable but not essential to include in some embodiments of the invention. In addition, details illustrated or disclosed with respect to any one aspect of the invention may be used with other aspects of the invention. Additional elements and/or steps may be added to various aspects of the invention and/or some disclosed elements and/or steps may be subtracted from various aspects of the invention without departing from the scope of the invention. Singular elements/steps imply plural elements/steps and vice versa. Some steps may be performed serially, in parallel, in a pipelined manner, or in different orders than disclosed herein. Many other variations are possible which remain within the content, scope, and spirit of the invention, and these variations would become clear to those skilled in the art after perusal of this application.

What is claimed is:

1. A valve housing comprising:

a protruding inlet, the protruding inlet being adapted to matingly fit a syringe housing;

a protruding outlet, the protruding outlet being adapted to matingly fit a paint tube housing;

and a valve having a closed position wherein a plug is axially restrained from forward and backward movement between a dispensing tip of the syringe housing and the valve so as to prevent fluid flow through the dispensing tip of the syringe housing in said closed position when the protruding inlet is matingly fitted to the syringe housing, and the dispensing tip of the syringe housing is in physical contact with the plug;

the valve being adapted such that the plug can be dislodged from the valve into the paint tube housing by a pressurized fluid in the syringe housing.

2. The valve housing of claim 1 wherein the protruding inlet is disposed proximate a shoulder portion.

3. The valve housing of claim 1 further comprising:

the protruding inlet having a threaded portion disposed on an outer surface thereof;

the threaded portion being adapted to matingly fit a threaded sleeve of the syringe housing.

4. The valve housing of claim 1 wherein the protruding outlet is adapted to friction fit a filling end of the paint tube housing.

5. The valve housing of claim 1 comprising:

the valve having a tapered portion configured to restrain and bias the plug towards the dispensing tip of the syringe housing.

6. A paint pen kit comprising:

the valve housing of claim 1;

a syringe housing having a threaded sleeve configured to matingly fit the protruding inlet of the valve housing;

a plunger configured to operatively engage the syringe housing whereby a fluid can be pressurized and dispensed at a variable rate through the dispensing tip of the syringe housing;

a paint tube housing having a filling end configured to matingly fit the protruding outlet of the valve housing; and an applicator disposed on a dispensing end of the paint tube housing.

7. A method of assembling and using a paint pen kit comprising the steps of:

obtaining the paint pen kit of claim 6, then matingly fitting the protruding outlet of the valve housing to the filling end of the paint tube housing;

then inserting the plug into the protruding inlet of the valve housing;

then matingly fitting the threaded sleeve of the syringe housing to the protruding inlet of the valve housing;

then dispensing a first fluid into an inner chamber of the syringe housing;

and then inserting the plunger into the syringe housing so as to urge the first fluid towards the dispensing tip of the syringe housing, whereby the plug is dislodged from the valve, and the first fluid is comingled with a second fluid in an inner chamber of the paint tube housing.

8. The method of assembling and using a paint pen kit of claim 7 further including the step of:

moving the paint tube housing such that the plug performs an agitating function.

* * * * *